US005765424A

United States Patent [19]

Mantovan

[11] Patent Number: 5,765,424

[45] Date of Patent: Jun. 16, 1998

[54] SIZING STAND FOR ROLLING HOT-ROLLED BARS

[75] Inventor: Gianfranco Mantovan, Busto Arsizio, Italy

[73] Assignee: Pomini S.p.A., Italy

[21] Appl. No.: 862,790

[22] Filed: May 23, 1997

Related U.S. Application Data

[63] Continuation of Ser. No. 201,921, Feb. 24, 1994.

[30] Foreign Application Priority Data

Feb. 25, 1993 [IT] Italy ..... MI93A0379

[51] Int. Cl.[6] ..... B21B 31/07; B21B 31/32

[52] U.S. Cl. ..... 72/245; 72/237

[58] Field of Search ..... 72/245, 244, 237

[56] References Cited

U.S. PATENT DOCUMENTS

| | | | |
|---|---|---|---|
| 3,369,383 | 2/1968 | Barnikel | 72/245 |
| 4,041,752 | 8/1977 | Dolenc et al. | 72/245 |
| 4,759,485 | 7/1988 | Braun et al. | 72/245 |
| 4,936,207 | 6/1990 | Niskanen et al. | 72/245 |

*Primary Examiner*—Lowell A. Larson
*Assistant Examiner*—Rodney Butler
*Attorney, Agent, or Firm*—Hedman, Gibson & Costigan, P.C.

[57] ABSTRACT

A sizing stand (10) for rolling hot-rolled bars (17) comprises at least one pair of rolling rolls (13) carried by chocks (12) mounted on a support frame (11). Said stand also comprises power means (14) able to compression-preload the rolling system with a load greater than the maximum working load.

2 Claims, 7 Drawing Sheets

SIZING STAND FOR ROLLING HOT-ROLLED BARS

This is a continuation of application Ser. No. 08/201,921, filed Feb. 24, 1994.

This invention relates to an improved sizing stand, which enables hot-rolled bars of a given size to be obtained with very narrow dimensional tolerances.

Using a standard rolling mill, it is currently possible to obtain hot-rolled bars with precise dimensional tolerances only in terms of their height, on which the finishing stand operates, whereas other dimensions such as width and shoulder dimensions, for example for a round product, are difficult to control, with the result that a highly precise average diameter and roundness cannot be obtained.

This is a serious drawback, because the market currently requires very narrow tolerances for products to be subjected to mechanical machining, such as peeling, grinding etc.

The object of the invention is to obviate this drawback by providing a sizing stand able to satisfy current market requirements, ie by producing hot-rolled bars of a given size with very narrow dimensional tolerances.

This object is attained by a sizing stand presenting the characteristics given in the accompanying claims.

The structural and operational characteristics of the invention and its advantages compared with the known art will be more apparent from an examination of the following description given with reference to the accompanying schematic drawings, which show one embodiment of a sizing stand incorporating the principles of the invention. On the drawings.

Figure 6:
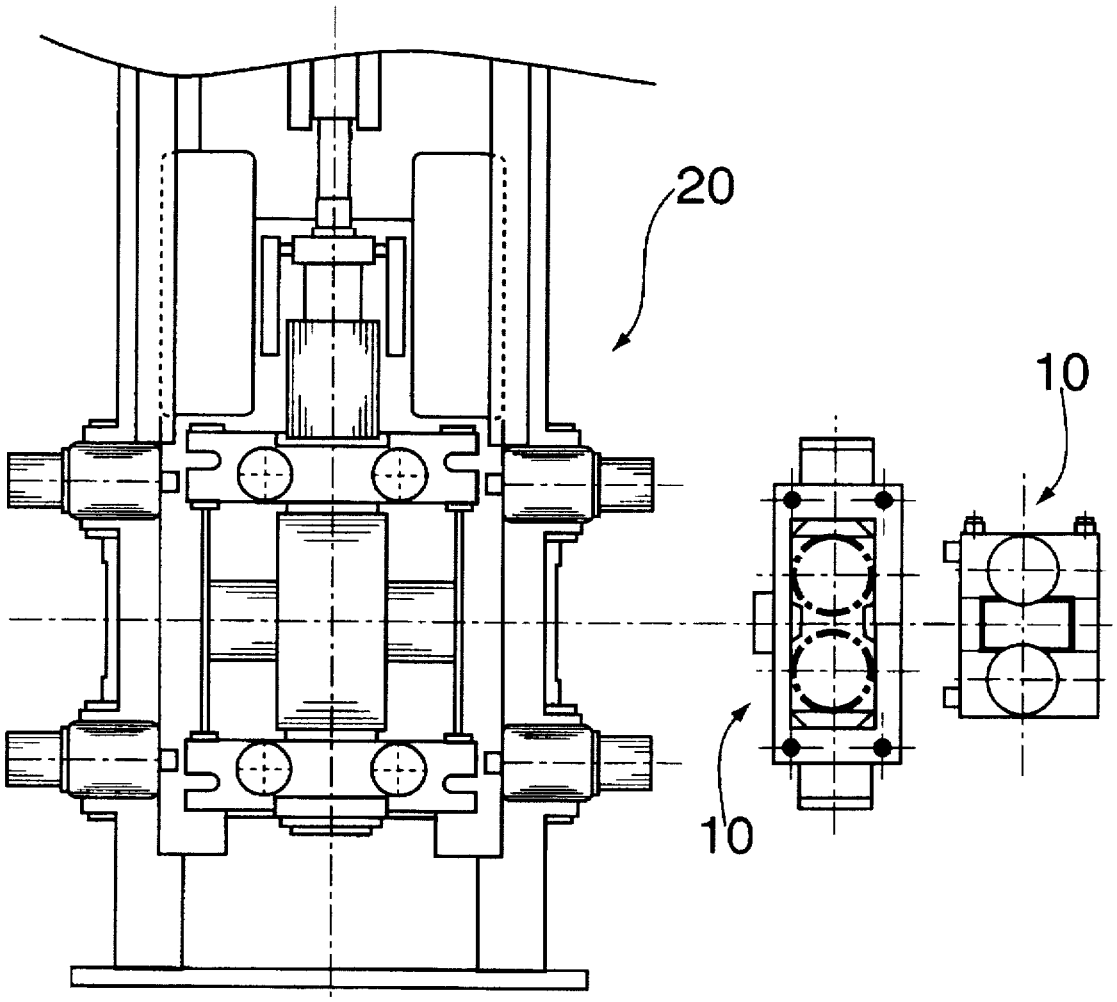
Figure 7:
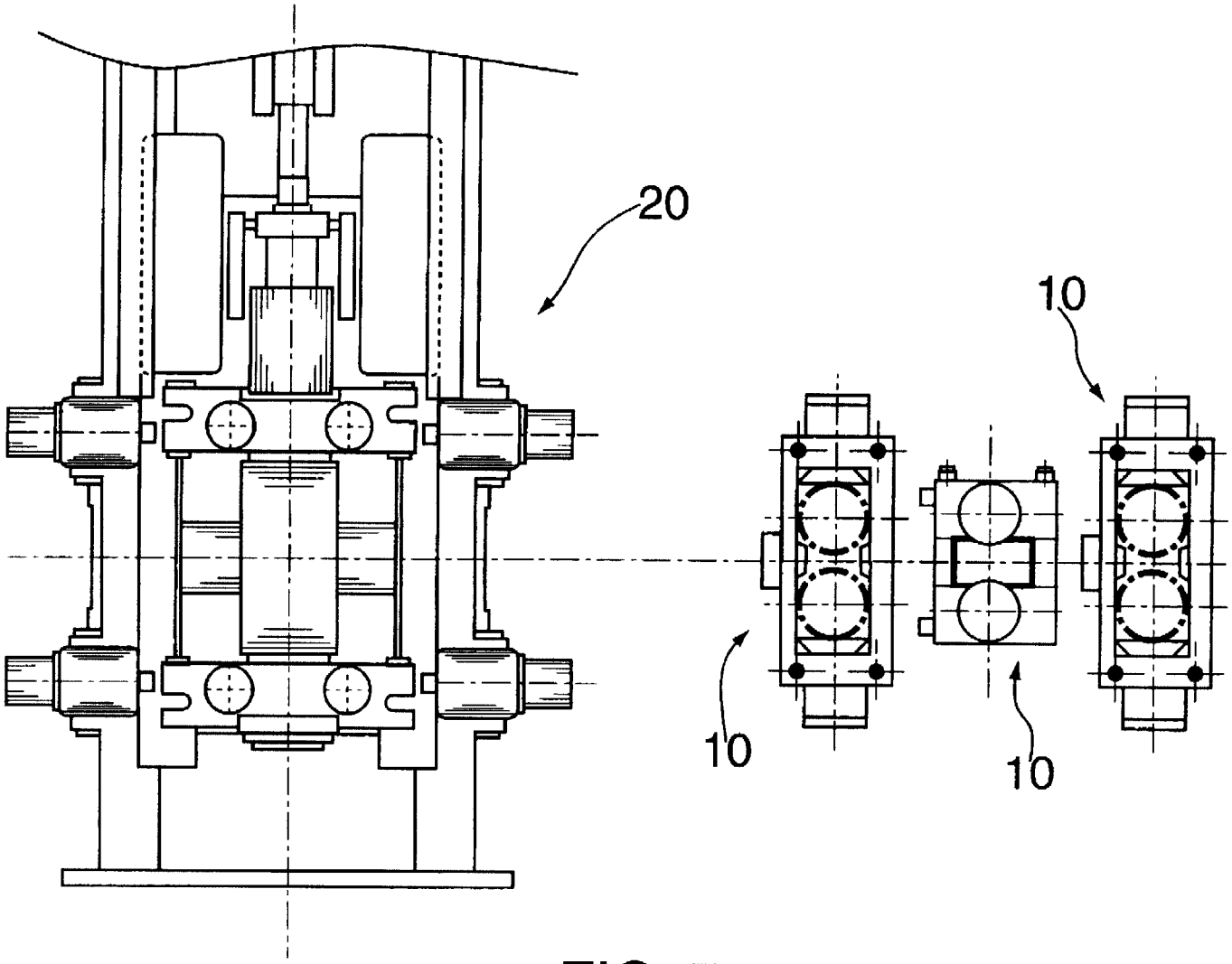

FIG. 6 is a scheme showing a rolling mill for rolling with imprecise tolerances, and comprising two sizing stands of the invention able to finish the product with narrow tolerances in terms both of height and width; and FIG. 7 is a scheme showing a rolling mill for rolling with imprecise tolerances, and comprising three sizing stands of the invention able to finish the product with narrow tolerances in terms both of height and width.

With reference to FIGS. 1–4, the sizing stand according to the invention is indicated overall by 10 and is formed structurally from a rigid closed-ring frame 11 within which are mounted chocks 12 carrying respective rolling rolls.

According to the invention, power means in the form of respective hydraulic pistons 14 act on said chocks 12 to compression-preload the system.

Wedge-shaped counteracting and adjustment elements 15 are positioned between the chocks 12. Said elements 15 can also be of different shape.

Figure 1:
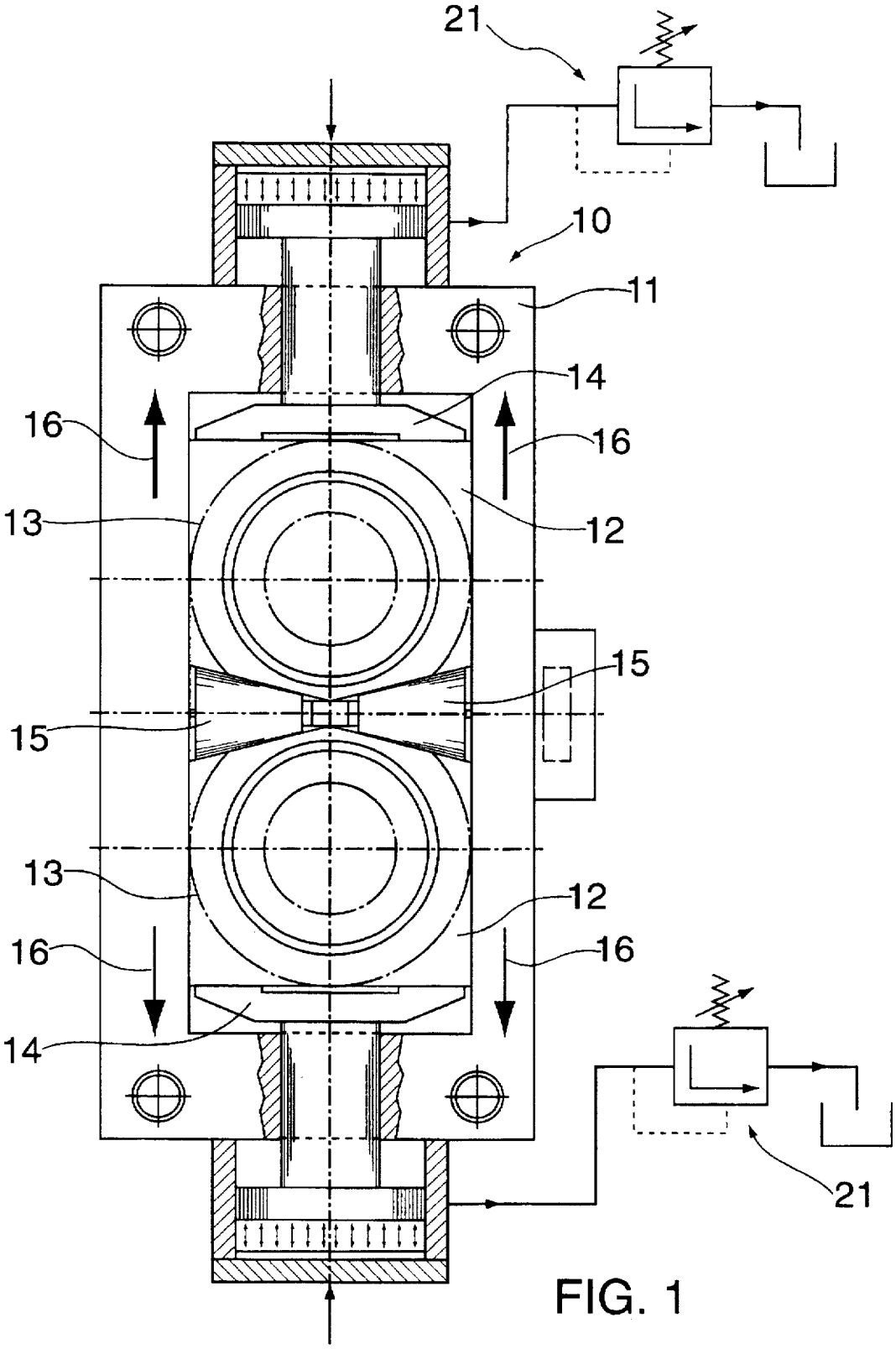
FIG. 1 is a longitudinal vertical schematic section showing a sizing stand according to the invention in a hydraulically preloaded but non-operating state.
Figure 2:
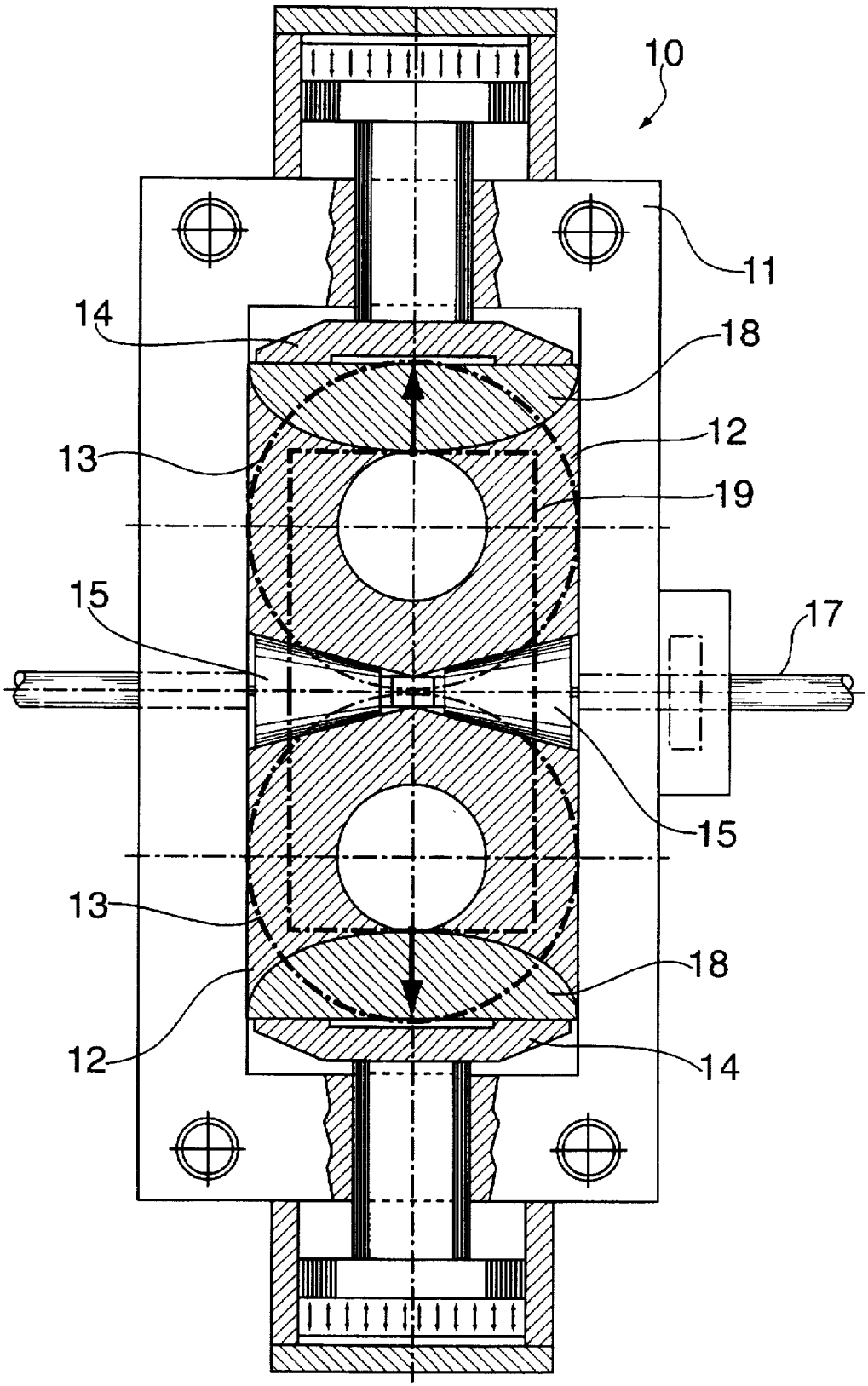
FIG. 2 is a view similar to FIG. 1 but showing the same preloaded sizing stand in the operating state rolling a bar.
Figure 3:
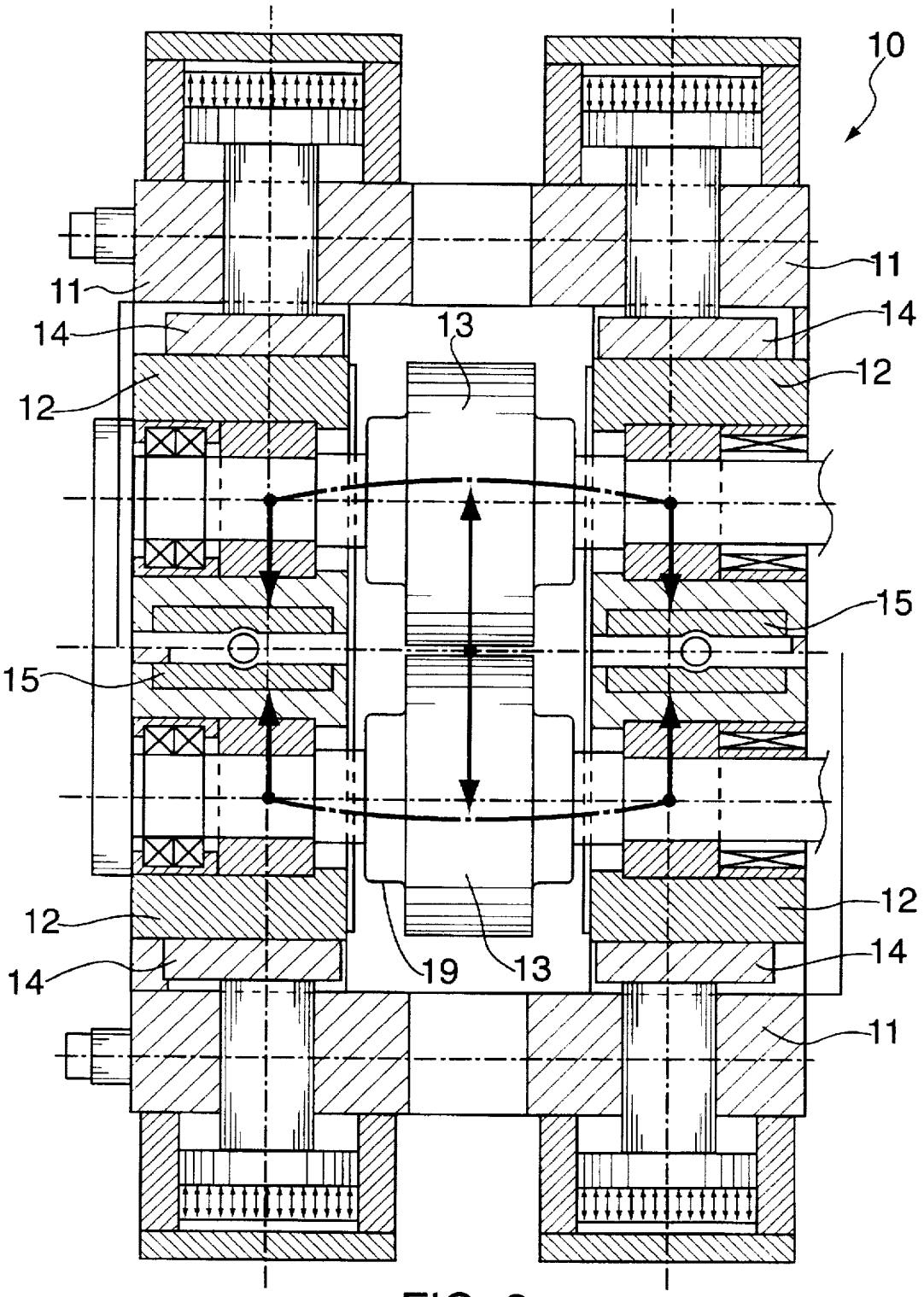
FIG. 3 is a vertical schematic cross-section showing the hydraulically preloaded sizing stand of the invention with the rolling rolls open (rolling with gap)

The sizing stand according to the invention shown in FIGS. 1–3 has high rigidity, achieved by the facility for hydraulically compression-preloading the chocks 12 and counteracting elements 15 with a load greater than the maximum working load.

FIG. 1 shows the preloaded system in the non-operating state with the rolls 13 open, the arrows 16 indicating the application of the piston 14 preloading forces to the frame 11.

FIG. 2 shows the preloaded system in the operating state, ie with a bar 17 undergoing rolling between the rolls 13.

The working load is discharged in the hatched regions 18 of the chocks 12, which are preloaded by the pistons 14 with a load greater than the working load.

In this situation the system comprising the chocks 12 and counteracting elements 15 is of very high rigidity and practically undeformable in that the only deformations are contained within the closed loop 19 shown by dashed and dotted lines in FIG. 2, so ensuring that the bar 17 is rolled to the required size with very narrow tolerances, unobtainable by rolling methods of the known art.

Figure 4:
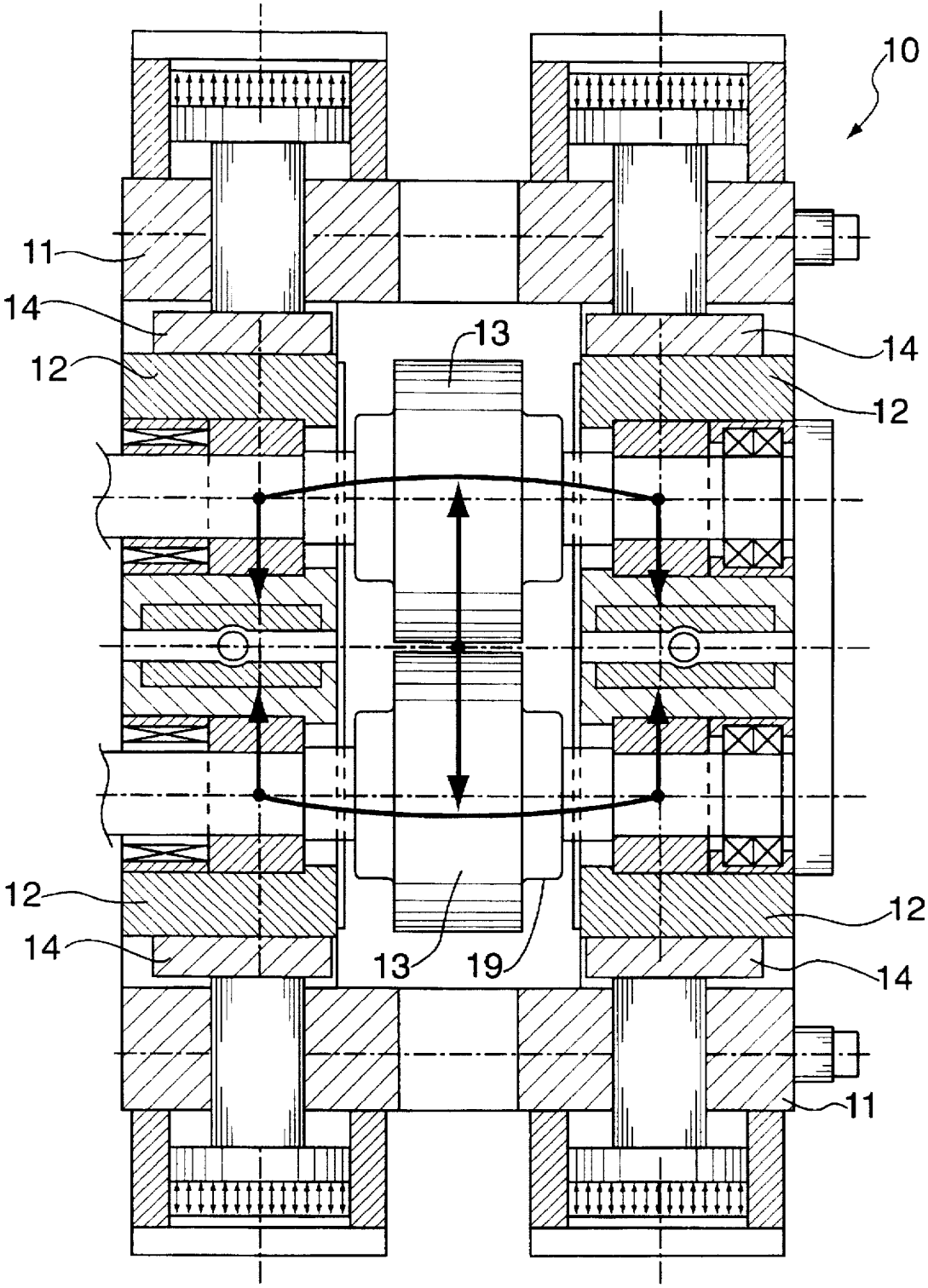
FIG. 4 is a view similar to FIG. 3 showing the same sizing stand in the operating state rolling a bar, with the rolling rolls closed (without gap)

The same results are also obtainable with the sizing stand of FIG. 4, which is arranged with mutually contacting rolls 13 against which the preloading force is discharged, and which in the preceding case (FIG. 3) was absorbed by the counteracting elements 15.

The advantages deriving from the use of a sizing stand according to the invention are directed both to the producer of hot-rolled bars and to their user.

The advantages to the producer can be summarized as follows:

- increased productivity;
- increased utilization of the rolling mill; and
- general cost reduction deriving from a lower cost of rolling rolls and a smaller number of test bars required to preset the roll train.

In practice, all these advantages derive from the fact of being able to obtain the entire product, from one end to the other, with a narrow tolerance even with variations in the cross-section of the product entering the sizing unit or rolling stand, due for example to roll wear or temperature variations.

The advantages to the user of hot-rolled bars can be summarized as follows:

- optimum dimensioning of the purchased product;
- reduction in processing costs deriving from the elimination of certain operations, such as extruding, peeling, grinding etc., and the use of maximum potential of the machinery which is to process the rolled product;
- reduction in scrap; and
- quicker dispatch.

In practice, all these benefits are due to the fact that because of the sizing stand of the invention, it is possible to approach tolerances achievable by mechanical machining, so that certain operations can be dispensed with and others facilitated by the greater precision of the rough-rolled product, the dimensions of which more greatly approach the nominal dimensions of the finished product.

As stated, the sizing stand of the invention can operate with a sized gap between the rolls, or with the rolls in contact.

In this latter case, with the rolls empty it is necessary to work with a low preload in order to reduce the roll wear, by reducing the load transmitted by the pistons 14 to the contacting surfaces. The preload is then increased to a value greater than the maximum working load when the bar is taken between the rolls.

The sizing stand is provided with a quick opening device in the case of excessive overload or jamming, it being controlled by a maximum pressure valve indicated schematically in FIG. 1 by 21. An adjustment device is provided for varying the distance between axes of the rolling rolls and for axial adjustment. These devices are not illustrated or described in detail herein as they are of a type well known to the expert of the art.

Figure 5:
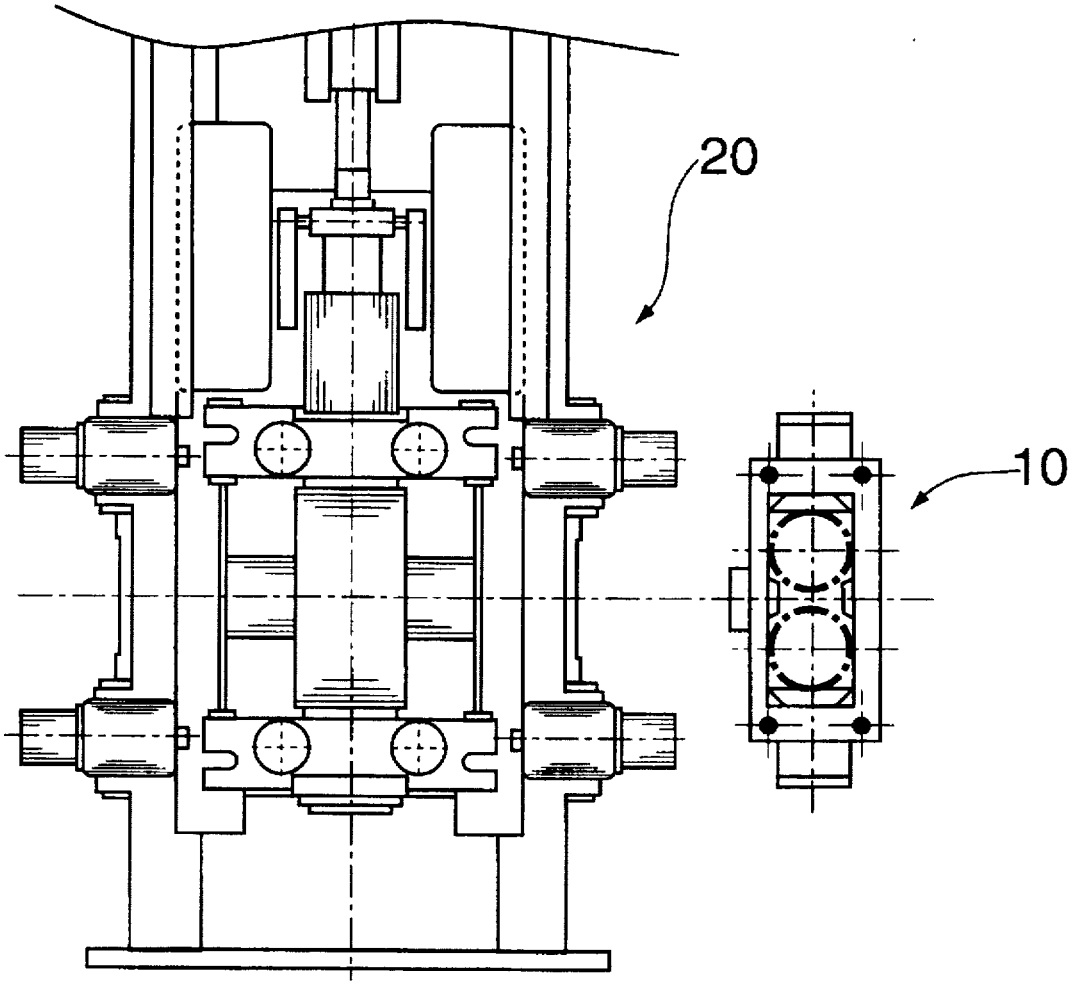
FIG. 5 is a scheme showing a rolling mill for rolling with precise height tolerances, and comprising the sizing stand of the invention.

FIG. 5 is a schematic diagram showing a rolling mill rolling with precise height tolerances.

In this case, typical of a fairly recent mill which rolls with a height tolerance as good as between about ½ and about ¼ Din, and which depending on the product concerned finishes on different finishing stands, a plant arrangement can be devised comprising only one sizing stand 10, positioned as close as possible downstream of a finishing stand 20 to work on the product width, so reducing the product dispersion in the width direction.

The unit would have to be a movable one which, depending on the rolled product, can be moved on the downstream side of the finishing stand 20 used.

FIG. 6 is a schematic diagram showing a rolling mill rolling with imprecise tolerances and finishing the product in a finishing mill 20.

In this case, typical of non-recent mills, a group of two sizing stands 10 could be installed positioned as close as possible downstream of the finishing stand 20 to reduce both height and width tolerances.

FIG. 7 is a schematic diagram showing a rolling mill rolling with imprecise tolerances and finishing the product in different stands, of which only the last 20 is shown.

This is perhaps the most typical case, involving the installation of a group of three sizing stands 10, positioned between the last finishing stand 20 and the shearing machine, without problems of closeness to said finishing stand 20, and which is able to reduce both width and height tolerances.

The sizing stand of the invention is of useful practical application in the production of sized bars intended for the manufacture of automobile parts (forged parts, springs etc.), bearings, weak alloy steel parts to be machined, and carbon steel and low-alloy steel parts to be cold finished.

I claim:

1. A sizing stand for rolling hot-rolled bars (17), said sizing stand comprising at least one pair of opposed rolling rolls (13) carried by opposed upper and lower chocks (12) which are mounted on a support frame ring (11), said support frame ring having a closed ring configuration, said upper and lower chocks (12) being separated by wedge shaped counteracting and adjustment elements (15), said upper and lower chocks (12) having associated independently adjustable, opposed hydraulic power means (14) which are able to compression-preload rolling rolls (13) by having hydraulic power means act on one another from opposite directions with a load that is greater than the maximum working load said load causing said working rolls to contact one another.

2. A sizing stand as claimed in claim 1 wherein frame (11) has a closed-ring configuration.

* * * * *